US008690284B2

(12) United States Patent
Takata et al.

(10) Patent No.: US 8,690,284 B2
(45) Date of Patent: Apr. 8, 2014

(54) LIQUID DISCHARGE APPARATUS

(75) Inventors: Masayuki Takata, Nagoya (JP); Tatsuya Shindo, Nagoya (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 135 days.

(21) Appl. No.: 13/359,972

(22) Filed: Jan. 27, 2012

(65) Prior Publication Data

US 2012/0249642 A1 Oct. 4, 2012

(30) Foreign Application Priority Data

Mar. 29, 2011 (JP) ..... 2011-072898

(51) Int. Cl.
*B41J 29/38* (2006.01)

(52) U.S. Cl.
USPC ..... 347/14; 347/65; 347/84; 347/85

(58) Field of Classification Search
USPC ..... 347/14, 20, 40–44, 47, 54, 68, 84–87, 347/65
See application file for complete search history.

(56) References Cited

U.S. PATENT DOCUMENTS

| | | | | |
|---|---|---|---|---|
| 2005/0212851 | A1* | 9/2005 | Akase et al. | 347/40 |
| 2008/0074467 | A1* | 3/2008 | Muraoka | 347/47 |
| 2008/0303862 | A1* | 12/2008 | Ito | 347/40 |
| 2009/0167821 | A1* | 7/2009 | Sugahara | 347/68 |

FOREIGN PATENT DOCUMENTS

| | | |
|---|---|---|
| JP | 4235057 | 8/1992 |
| JP | 3036548 | 4/2000 |
| JP | 200-159816 | 6/2003 |
| JP | 2005-262551 | 9/2005 |
| JP | 2008-265057 | 11/2008 |

OTHER PUBLICATIONS

Notice of Reasons for Rejection for Japanese for Patent Application No. 2011-072898 dated Apr. 9, 2013.
Partial English translation for JP 3036548.

* cited by examiner

*Primary Examiner* — Manish S Shah
*Assistant Examiner* — Yaovi Ameh
(74) *Attorney, Agent, or Firm* — Frommer Lawrence & Haug LLP

(57) ABSTRACT

There is provided a liquid discharge apparatus including a liquid discharge head having a plurality of nozzles; a common chamber; a liquid chamber; a liquid supply port; and a communication channel; and a discharge control mechanism which controls the liquid discharge head to perform a discharge operation of discharging the liquid from the nozzles to the medium. The discharge control mechanism controls the liquid discharge head to perform a flushing operation, as the discharge operation, so that the liquid is discharged from a first nozzle group in a discharge mode, which is different from a discharge mode of a second nozzle group, to generate a flow of the liquid in the communication channel.

10 Claims, 7 Drawing Sheets

LIQUID DISCHARGE APPARATUS

CROSS REFERENCE TO RELATED APPLICATION

The present application claims priority from Japanese Patent Application No. 2011-072898, filed on Mar. 29, 2011, the disclosure of which is incorporated herein by reference in its entirety.

BACKGROUND OF THE INVENTION

1. Field of the Invention

The present invention relates to a liquid discharge apparatus which discharges a liquid.

2. Description of the Related Art

An ink jet type recording apparatus is known as an example of the liquid discharge apparatus which discharges a liquid (ink), including a recording head which has a discharge surface formed with a plurality of nozzles for discharging the ink, a recording control mechanism which controls the recording operation for performing the recording by driving the recording head and discharging the ink from the nozzles to the recording medium, and a flushing control mechanism which allows the ink to be discharged from the nozzles by driving the recording head distinctly from the recording operation. The known ink-jet type recording apparatus is provided with the recording head having a plurality of ink manifolds which extend in the extending direction, which are provided with an ink supply port disposed on one end side in the extending direction, and which are communicated with the respective nozzles, and a communication channel which is provided on the other end side in the extending direction of the plurality of ink manifolds and which makes communication between the plurality of ink manifolds (see Japanese Patent No. 3036548).

In such an arrangement, the plurality of ink manifolds are provided for the recording head and the communication channel is provided to make communication between the plurality of ink manifolds for the purpose of mitigating harmful effects of the water hammer phenomenon. In the recording head, the execution of ink discharge and the stop of ink discharge are intermittently repeated in order to perform the recording. In such a situation, if the terminal end of the ink manifold is closed, the water hammer phenomenon arises such that the pressure wave, which is generated by the repetition of the ink discharge, is transmitted through the ink channel. However, when the communication channel is provided at the terminal end of the ink manifold, then the pressure wave is also transmitted to the interior of the communication channel, the pressure wave is weakened, and it is possible to mitigate the harmful effects of the water hammer phenomenon. In this arrangement, the communication channel is communicated with dummy nozzles formed on the discharge surface of the recording head. The liquid droplets are not discharged from the dummy nozzles during the recording operation. The ink is merely discharged during the purge operation in order to maintain the performance for discharging the ink. Therefore, the ink contained in the communication channel remains in such a state that the ink stays and stops in the communication channel during any period other than the period in which the purge operation is performed.

SUMMARY OF THE INVENTION

In the case of the ink-jet type recording apparatus described in Japanese Patent No. 3036548, the flushing operation, in which the amount of consumption of the ink is smaller than that consumed in the purge operation, is performed relatively frequently as compared with the purge operation. During the flushing operation, the ink liquid droplets are not discharged from the dummy nozzles, and the ink is scarcely moved in the communication channel as well. Therefore, even when only the flushing operation is performed, it is impossible to suppress the increase in viscosity of the ink in the communication channel and the staying of the bubble in the communication channel. As a result, it is impossible to mitigate the harmful effects of the water hammer phenomenon, and the discharge performance of the recording head is lowered. In view of the above, it is conceived that the viscosity-increased ink is discharged by the purge operation when the ink contained in the communication channel undergoes the increase in viscosity. When the degree of the increase in viscosity of the ink in the communication channel is high, it is impossible in some cases to discharge the ink from the interior of the communication channel even when the purge operation is performed. On the other hand, it is also conceived that the frequency of the purge operation is raised in order to discharge the ink before the viscosity of the ink increases in the communication channel. However, the amount of ink consumption in the purge operation is larger than that in the flushing operation. Therefore, if the frequency of execution of the purge operation is raised, the ink is uselessly consumed.

An object of the present teaching is to provide a liquid discharge apparatus in which the discharge performance of a recording head can be maintained by generating the flow of a liquid in a communication channel by utilizing the flushing operation in which the amount of consumption of the liquid is smaller than that consumed in the purge operation.

According to an aspect of the present teaching, there is provided a liquid discharge apparatus which discharges a liquid to a medium, including:

a liquid discharge head having a plurality of nozzles through which the liquid is discharged; a common chamber communicated with the nozzles and extending in an extending direction; a liquid chamber; a liquid supply port through which the liquid is supplied to the common chamber and the liquid chamber; and a communication channel which makes communication between the liquid chamber and the common chamber; and a discharge control mechanism which is configured to control the liquid discharge head to perform a discharge operation of discharging the liquid from the nozzles to the medium, wherein a plurality of nozzles have a first nozzle group and a second nozzle group, wherein the discharge control mechanism controls the liquid discharge head to perform a flushing operation, as the discharge operation, so that the liquid is discharged from the first nozzle group in a discharge mode, which is different from a discharge mode of a second nozzle group, to generate a flow of the liquid in the communication channel.

In this way, the flow is generated in the liquid contained in the communication channel by effectively utilizing the flushing operation in which the amount of consumption of the liquid is small so that the liquid contained in the communication channel is moved as much as possible and thus it is possible to prevent any bubble or the like from staying in the communication channel. Therefore, the discharge performance can be maintained without increasing the amount of consumption of the liquid.

DESCRIPTION OF THE PREFERRED EMBODIMENTS

An embodiment of the present teaching will be explained below with reference to the drawings.

Figure 1:
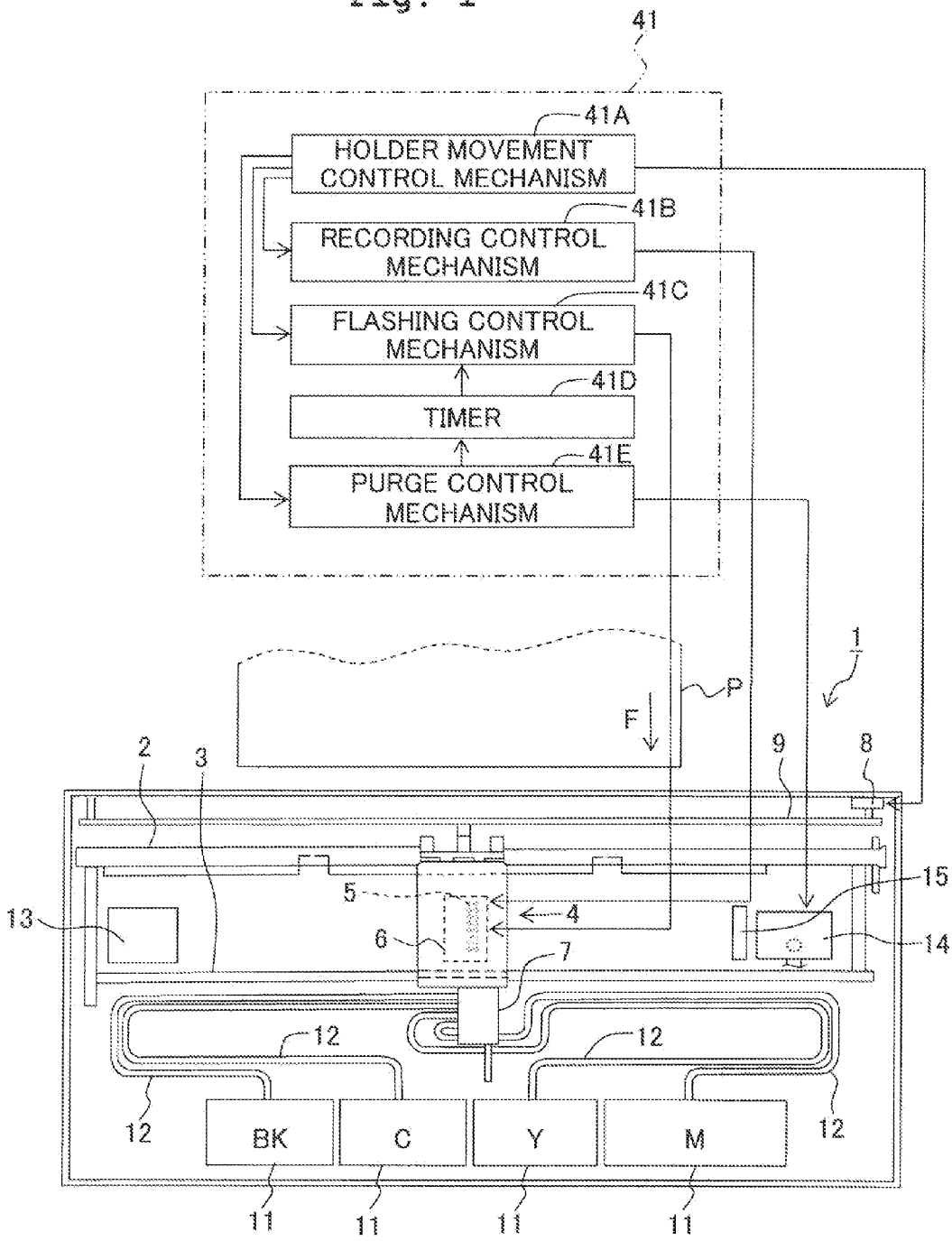
FIG. 1 illustrates a schematic arrangement of an ink-jet type recording apparatus as one embodiment of the liquid discharge apparatus according to the present invention.

In the following explanation, it is assumed that the side of, for example, the ink-jet type recording apparatus and the recording head, on which the ink is discharged, is designated as "lower surface" and "downward direction", and the side, which is opposite thereto, is designated as "upper surface" and "upward direction". With reference to FIG. 1, it is assumed that the left end side of the drawing is designated as "leftward direction", the right end side is designated as "rightward direction", the lower edge side of the drawing is designated as "frontward", and the upper edge side of the drawing is designated as "backward".

As shown in FIG. 1, two guide shafts 2, 3 are provided in parallel in an ink-jet type recording apparatus 1. A head holder 4, which functions as a carriage, is slidably supported by the guide shafts 2, 3. A recording head 6 (liquid discharge head) having a discharge surface formed with a plurality of nozzles 5 through which inks (liquids) are discharged and a plurality of ink tanks 7 which stores the inks of a plurality of colors respectively are provided on the head holder 4. The recording head 6 performs the recording on the recording paper P (medium) by discharging the inks from the nozzles 5.

Figure 2:
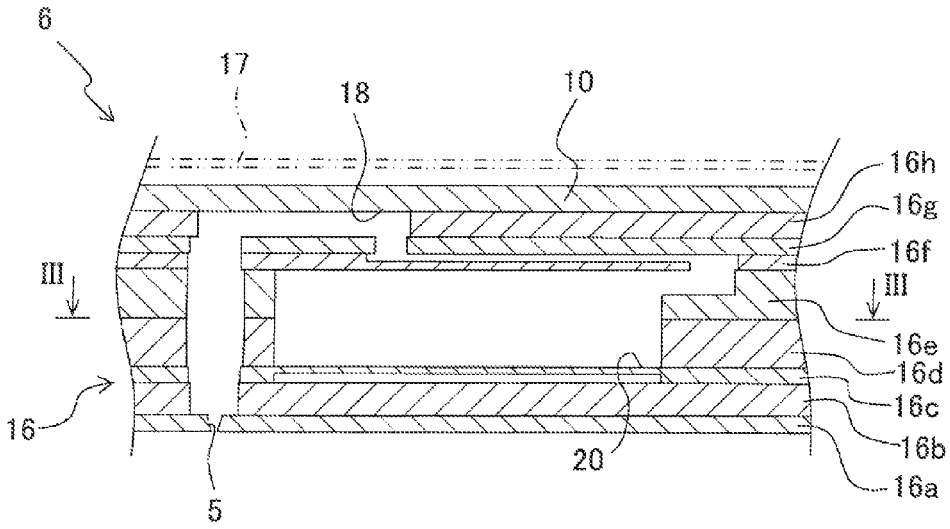
FIG. 2 shows a sectional view illustrating a cavity unit for constructing a recording head.

The head holder 4 is fixed to an endless belt 9 which is driven and rotated by a motor 8. The head holder 4 is reciprocatively scanned in the widthwise direction (left-right direction) of the recording paper P along the guide shafts 2, 3 in accordance with the driving of the motor 8. The recording paper P is fed in the direction of the arrow F shown in FIG. 1 by means of a transport unit (not shown) provided in the ink-jet printer 1. A driving pulse, which is provided in order to discharge the ink, is applied to a piezoelectric actuator 10 (see FIG. 2) of the recording head 6, and the ink is discharged from the nozzles 5 during the period in which the head holder 4 is reciprocatively scanned in the widthwise direction of the recording paper P (left-right direction, scanning direction) in the plane parallel to the recording paper P. In this way, the recording is performed on the recording paper P. The area, which is overlapped with the recording paper P and which is included in the area for the head holder 4 subjected to the reciprocative scanning, is referred to as "recording area", and the area, which is disposed outside the recording paper P, is referred to as "non-recording area".

The ink-jet printer 1 is provided with a plurality of ink cartridges 11 in which the inks of a plurality of colors (for example, four color inks of black BK, cyan C, magenta M, and yellow Y) are accommodated respectively. The ink cartridges 11 are connected to ink tanks 7 via flexible ink supply tubes 12 respectively. The inks, which are stored in the ink tanks 7 while being classified by the respective colors, are supplied to the nozzles 5.

A flushing receiving member 13 is provided in the non-recording area which is disposed adjacently on the left side of the recording area. The flushing receiving member 13 is constructed so that a porous ink-absorbing material (for example, urethane foam) which receives and absorbs the waste inks discharged from the recording head 6 is accommodated in a tank. The recording head 6, which is arranged on the head holder 4, is periodically or forcibly moved to the restoring position facing the flushing receiving member 13, for example, before the start of the recording or during the recording. The inks are discharged from the nozzles 5 of the recording head 6 as described later on to perform the flushing operation in order to restore the ink discharge performance.

A purge unit 14 (purge mechanism) is provided in the non-recording area which is disposed adjacently on the right side of the recording area, the purge unit 14 (purge mechanism) having a cap (not shown) which makes tight contact with the discharge surface of the recording head in order to perform the suction purge operation so that the ink discharge performance is restored by discharging the inks from the nozzles 5 in a state in which the cap is brought in tight contact with the discharge surface. The cap is provided so that the cap is capable of making tight contact and separation with respect to the discharge surface of the recording head 6. The cap is constructed so that the purge operation can be performed by means of a known pump in a state in which the cap is brought in tight contact with the discharge surface. A wiper unit (wiper member) 15 is provided while being aligned with the purge unit 14. The inks, which are adhered to the discharge surface after the purge operation, can be wiped out by. means of the wiper unit 15.

The recording head 6 is provided with a cavity unit 16, a plate-shaped piezoelectric actuator 10 which is joined thereon by means of an adhesive, and a flexible printed circuit board 17 having flexibility which is electrically joined on an upper surface of the piezoelectric actuator 10.

The cavity unit 16 is constructed by stacking a plurality of plates **16*a* to 16*h*. The plurality of nozzles 5 are formed in an array form for the plate 16*a* which is disposed at the lowermost layer. On the other hand, a plurality of pressure chambers 18, which have elliptical shapes as viewed in a plan view, are formed in an array form for the plate 16*h* which is disposed at the uppermost layer. The shape of the pressure chamber 18 is not limited thereto, which may be formed to have any arbitrary shape. One end in the longitudinal direction of each of the plurality of pressure chambers 18 is communicated with one of the plurality of nozzles 5, and the other end is communicated with any one of ink manifolds 19, 20, 21, 22 (common liquid chambers) in relation to each of the ink colors one by one. The ink, which is supplied from the ink tank 7, is distributed via one of the ink manifolds 19 to 22 to the plurality of pressure chambers 16 respectively. The ink arrives at the nozzles 5 corresponding to the respective pressure chambers 16 respectively, and the ink is discharged from the nozzles 5**.

Figure 3:
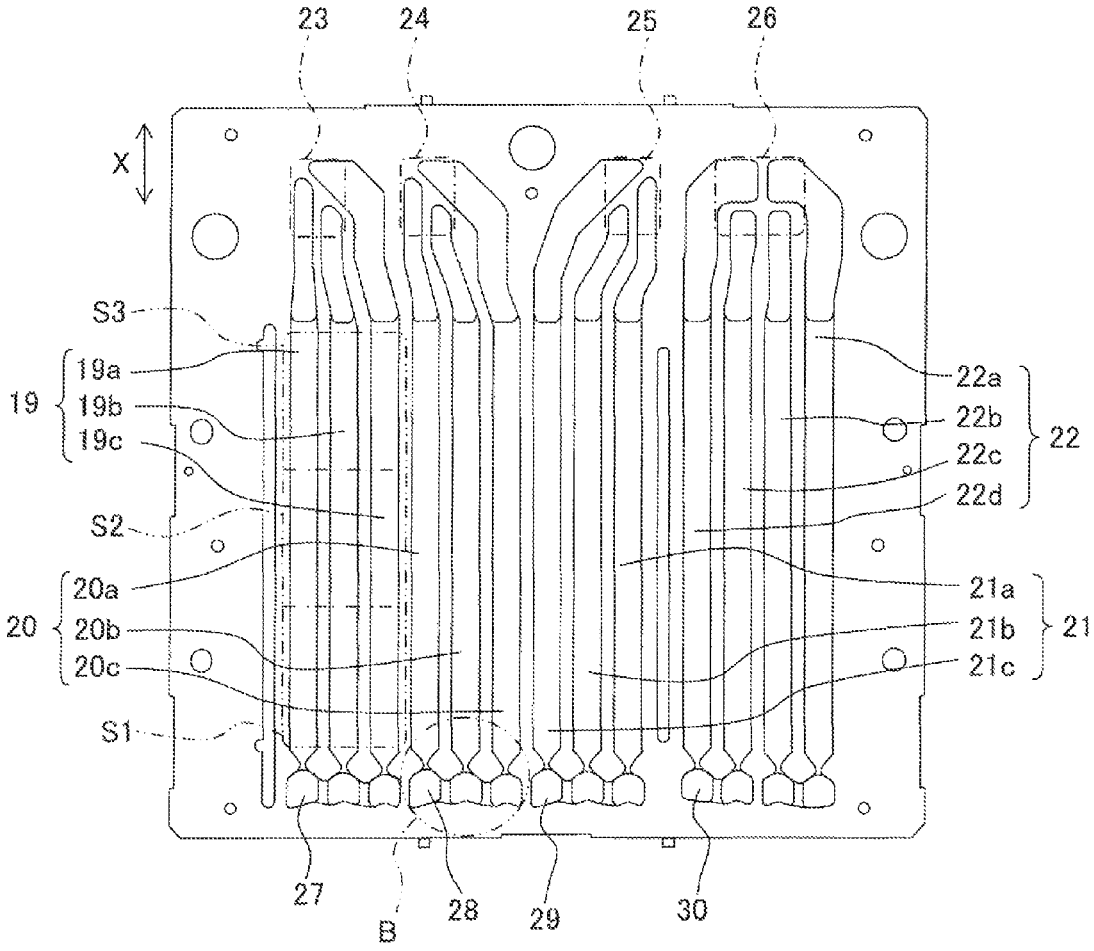
FIG. 3 shows a view taken along a line III-III indicated by arrows shown in FIG. 2.
Figure 4:
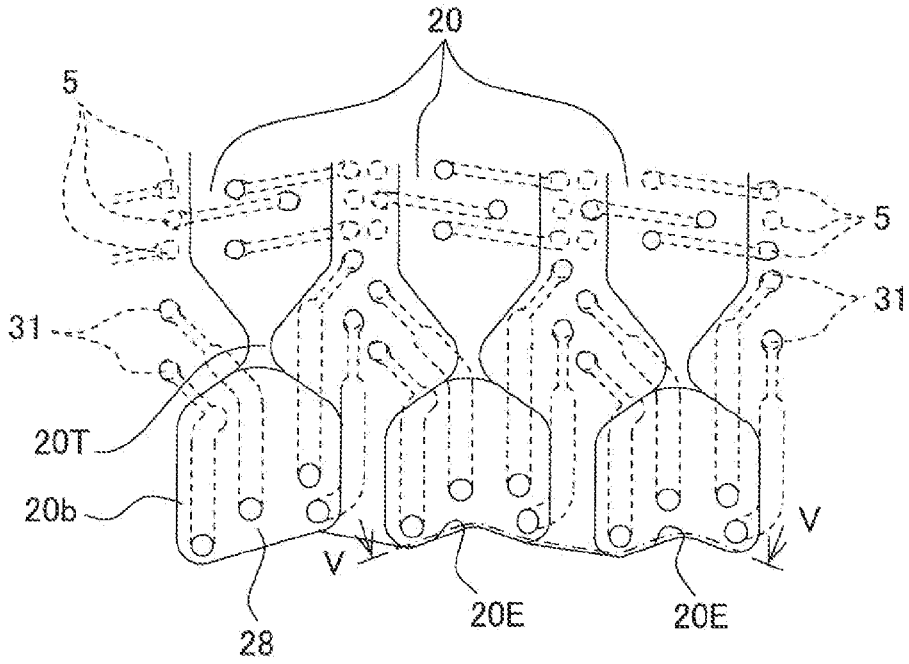
FIG. 4 shows an enlarged view illustrating a portion B shown in FIG. 3.
Figure 5:
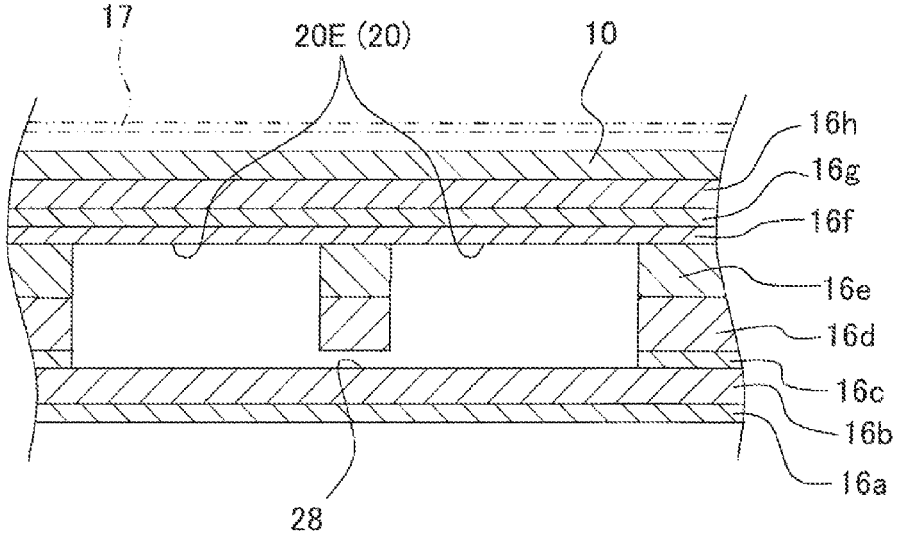
FIG. 5 shows a sectional view taken along a line V-V shown in FIG. 4.

As shown in FIGS. 3 to 5, the plurality of ink manifolds 19 to 22 are communicated with the nozzles 5. The ink manifolds 19 to 22 extend in parallel to one another in a predetermined extending direction X respectively. Ink supply ports 23, 24, 25, 26 are formed on one end side of the cavity unit 16 in the extending direction of the plurality of ink manifolds 19 to 22. Communication channels 27, 28, 29, 30, which make communication between the plurality of ink manifolds 19 to 22, are formed on the other end side in the extending direction X. The communication channels 27 to 30 are formed in the plate 16*c* disposed on the lower side of the plates 16*e*, 16*d* in which the ink manifolds 19 to 22 are formed (see FIG. 5). As shown in FIG. 4, a throttle portion 20T is formed on the other end side of the ink manifold 20, and an elongated portion 20E is formed on the further end side of the throttle portion 20T. The communication channel 28 is provided for the elongated portion 20E.

The piezoelectric actuator 10 has a plurality of stacked piezoelectric ceramics layers such as PZT or the like (thickness of one sheet: about 30 μm). Although not specifically shown in the drawing, individual electrodes are provided respectively between the piezoelectric ceramics layers at portions corresponding to the pressure chambers 18 of the cavity unit 16. A common electrode, which is provided commonly to the plurality of pressure chambers 18, is arranged on the piezoelectric ceramics layer. The piezoelectric ceramics layer is interposed by the individual electrode and the common electrode.

A driving IC chip (not shown), which contains a driving circuit, is provided on the flexible printed circuit board 17. The driving IC chip is electrically connected to the electrodes of the piezoelectric actuator 10. When the driving circuit generates the driving pulse to apply the voltage between the common electrode and the individual electrode, the active portion of the ceramics layer, which is interposed between the electrodes, is displaced to change the volume of the pressure chamber 18. The pressure is exerted on the ink contained in the pressure chamber 18 in accordance with the volume change of the pressure chamber 18. During the actual recording, the inks are discharged from the nozzles 5 toward the recording paper P to perform the recording. On the other hand, when the flushing operation is performed to restore the discharge performance of the recording head 6, the recording head 6 is moved and stopped at the position facing the flushing receiving member 13. The recording head 6 is driven in this state distinctly from the recording operation, and the inks are discharged a plurality of times from all of the nozzles 5 toward the flushing receiving member 13.

Dummy nozzles 31, which are communicated with the communication channels 27 to 30 and from which any liquid droplet is not discharged during the recording operation, are formed on the discharge surface of the recording head 6 (see FIG. 4). During the purge operation, the purge unit 14 allows the cap to make tight contact with the discharge surface so that all of the nozzles 5 and the dummy nozzles 31 are covered with the cap, and the inks are discharged from the nozzles 5 and the dummy nozzles 31. In other words, the flow of the ink is generated in the communication channel 28 by means of the purge operation performed by the purge unit 14, and the increase in viscosity of the ink is suppressed. The reason, why the liquid droplet is not discharged from the dummy nozzle 31 during the recording operation, is that any driving electrode is not provided for the pressure chamber 18 corresponding to the dummy nozzle 31.

As shown in FIG. 1, a control mechanism 41 is connected to the recording head 6. The control mechanism 41 includes a holder movement control mechanism 41A which controls the movement of the head holder 4, a recording control mechanism 41B which controls the recording operation for discharging the inks from the nozzles 5 to the recording paper P to perform the recording by driving the recording head 6, a flushing control mechanism 41C which allows the inks to be discharged from the nozzles 5 by driving the recording head 6 distinctly from the recording operation, a timer 41D which measures the elapsed time after the purge operation performed by the purge unit 14, and a purge control mechanism 41E which drives and controls the purge unit 14.

Each of the nozzles 5 of the recording head 6 is communicated with any one of the ink manifolds 19 to 22. In this arrangement, the ink manifold 19 has three sub-manifolds 19*a*, 19*b*, 19*c*. The nozzles 5, which are communicated with the ink manifold 19, are divided into those of three nozzle groups corresponding to the sub-manifolds 19*a* to 19*c*. Similarly, each of the ink manifolds 20 to 22 also includes three (or four) sub-manifolds 20*a* to 20*c*, 21*a* to 21*c*, 22*a* to 22*d*. The nozzles 5 are divided into those of nozzle groups corresponding to the sub-manifolds 20*a* to 20*c*, 21*a* to 21*c*, 22*a* to 22*d*. The flushing control mechanism 41C drives the recording head 6, for example, periodically so that the first flushing operation is performed to generate the flow of the ink in the communication channel of one concerning ink manifold by discharging the ink from one nozzle group of the plurality of nozzle groups communicated with one concerning ink manifold at a discharge timing which is different from that of the other nozzle group.

As for the control in which the first flushing operation is performed in the discharge mode for one nozzle group different from that of the other nozzle group, for example, it is conceived to perform the control (first control) in which the timing for discharging the ink is changed between one nozzle group and the other nozzle group. An explanation will be made as exemplified by the ink manifold 19 by way of example. However, the same explanation also holds in relation to the other ink manifolds 20 to 22. When the consideration is made at a specified timing, the amount of consumption of the ink, which is based on the discharge of the ink in accordance with the flushing operation, differs among the sub-manifolds 19*a* to 19*c*. On account of this cause, the flow of the ink arises in the communication channel 27. When the flow of the ink is generated as described above, the ink, which is contained in the communication channel 72, is also discharged in accordance with the flushing operation in some cases.

Further, the following control (second control) is also conceived as an example of another control for performing the first flushing operation. Also in this case, an explanation will be made as exemplified by the ink manifold 19 by way of example. However, the same explanation also holds in relation to the other ink manifolds 20 to 22. The nozzles 5 of each of the nozzle groups are divided into those of a plurality of subgroups depending on the distance from the communication channel 27. The control is performed to drive the recording head 6 for one nozzle group so that the ink is discharged in an order starting from the subgroup disposed nearer to the communication channel 27. In this procedure, the recording head 6 is controlled so that the ink discharge timing is changed between one nozzle group and the other nozzle group. Accordingly, it is possible to generate the flow of the ink in the communication channel 27. For example, as shown in FIG. 3, the sub-manifold 19*a* is divided into three areas S1, S2, S3 depending on the distance from the communication channel 27. The nozzle group, which is communicated with the sub-manifold 19*a*, is divided into three subgroups (first subgroup to third subgroup) communicated with the three areas S1 to S3. At first, the recording head 6 is driven so that the ink is discharged from the first subgroup composed of the nozzles 5 communicated with the area S1. Subsequently, the recording head 6 is driven so that the ink is discharged from the second subgroup composed of the nozzles 5 communicated with the area S2. Subsequently, the recording head 6 is driven so that the ink is discharged from the third subgroup composed of the nozzles 5 communicated with the area S3. The ink manifold 19 has the three sub-manifolds 19*a* to 19*c*. Therefore, the same control can be also performed for the other two sub-manifolds (19*b*, 19*c*).

Also in the second control described above, the ink is discharged in an order starting from the subgroup of the nozzles disposed nearer to the communication channel in relation to at least one nozzle group. As a result, the control is performed so that the discharge mode for discharging the ink is changed between the one entire nozzle group and the other entire nozzle group. When the ink manifold 19 is exemplified by way of example, if the recording head 6 is controlled so that the ink is discharged at the same timing and in the same discharge mode in relation to all of the sub-manifolds 19*a* to 19*c*, then it is impossible to generate the flow of the ink in the communication channel 27. Therefore, it is necessary to control the recording head 6 so that the ink is discharged in any different discharge mode or at any different timing in relation to the nozzles 5 communicated with at least one sub-manifold as compared with the nozzles 5 communicated with the other sub-manifold.

As described above, the nozzles 5 are divided into the nozzles 5 of the plurality of nozzle groups communicated with the sub-manifolds 19*a* to 19*c* of the ink manifold 19 respectively. The flushing control mechanism 41C drives the recording head 5 so that the first flushing operation is performed to discharge the ink in accordance with the different discharge mode in relation to one nozzle group of the plurality of nozzle groups as compared with the other nozzle groups. Thus, the flow of the ink is generated in the communication channel 27. Accordingly, the ink is prevented from the increase in viscosity in the communication channel 27 by effectively utilizing the flushing operation in which the amount of consumption of the ink is smaller than that of the purge operation. The ink manifolds 20 to 22 are also operated in the same manner as described above.

Other than the embodiment described above, the present teaching is applicable to any modification as follows.

In the embodiment described above, the flushing control mechanism 41C performs the control to change the timing for discharging the ink between one nozzle group and the other nozzle group. However, the present teaching is not limited thereto. For example, the flushing control mechanism 41C may perform the control such that the ink discharge amount is changed between one nozzle group and the other nozzle group in relation to a certain ink manifold. When the ink discharge amount is changed, the sizes of the ink droplets may be changed. Alternatively, it is also allowable to change, for example, the number of ink droplets to be discharged continuously, the ink discharge amount per unit time, and the ink discharge time. In this way, the ink is discharged from one nozzle group of the plurality of nozzle groups communicated with the certain ink manifold in accordance with the discharge mode which is different from that of the other nozzle group, and thus it is also possible to generate the flow of the ink in the communication channel communicated with the concerning manifold. By doing so, even when the timing for discharging the ink is not necessarily different from each other, the flow of the ink is generated in the communication channel, for example, owing to the fact that the ink discharge amount is changed between one nozzle group and the other nozzle group.

In the embodiment described above, the flushing control mechanism 41C performs the first flushing operation singly. When the purge operation is performed by the purge unit 14, the inks are discharged from all of the nozzles 5 and the dummy nozzles 31. Therefore, the flow of the ink is generated in the communication channels 27 to 30 in accordance with the purge operation, and the increase in viscosity of the ink is suppressed. Therefore, it is not necessarily indispensable to drive the recording head 6 for a certain period of time after performing the purge operation so that the first flushing operation is performed to generate the flow of the ink in the communication channels 27 to 30 by changing the timing for discharging the ink between one nozzle group of the plurality of nozzle groups and the other nozzle group during the flushing operation.

Accordingly, in this case, the flushing control mechanism 41C can also allow the recording head 6 to perform the second flushing operation for discharging the ink from the nozzles 5 so that all of the nozzles belonging to the plurality of nozzle groups are in the same discharge mode. In the second flushing operation, the flow of the ink is not generated in the communication channels 27 to 30, because the ink is discharged from the nozzles 5 so that all of the nozzles belonging to the plurality of nozzle groups are in the same discharge mode.

Figure 6:
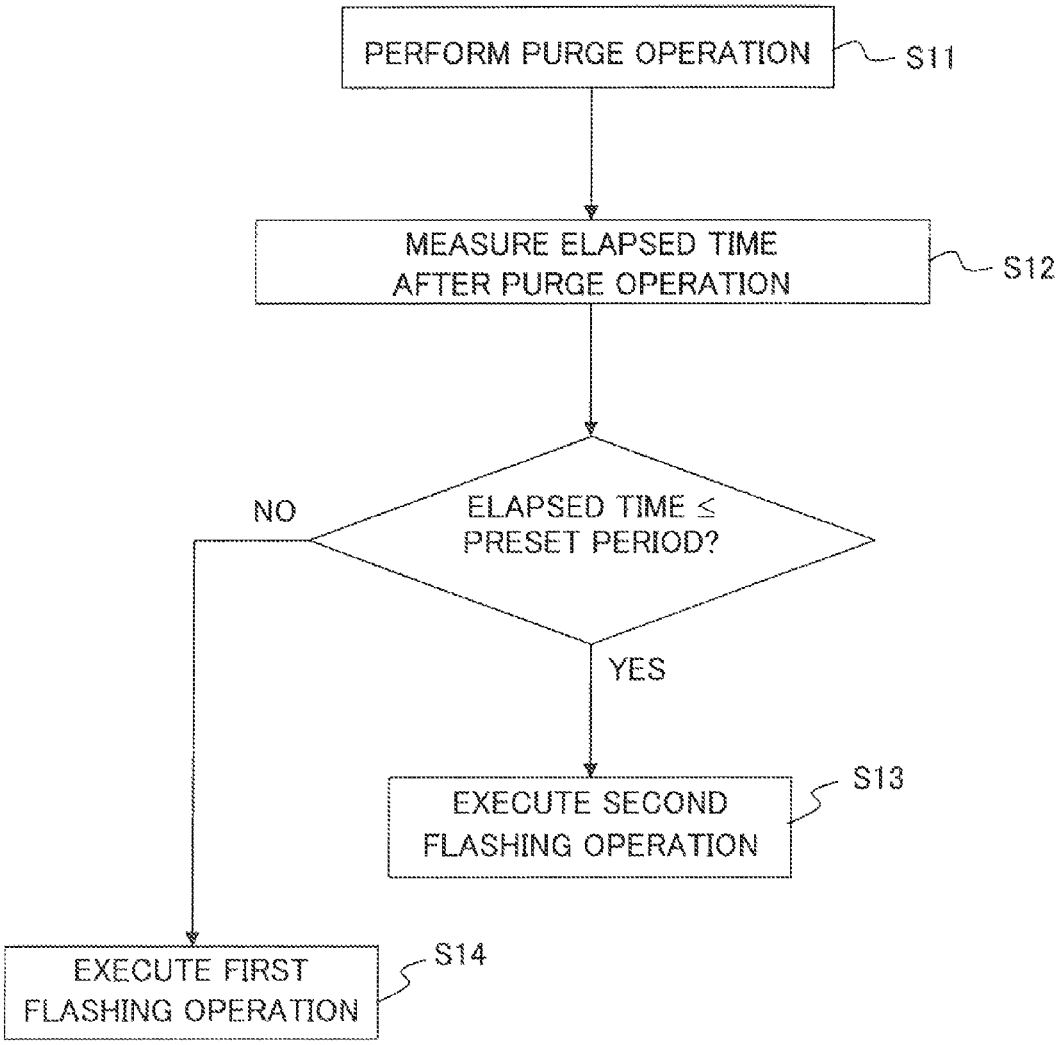
FIG. 6 shows a flow chart illustrating the control in which a purge operation and first and second flushing operations are combined.

An explanation will be made with reference to a flow chart shown in FIG. 6 about the control in which the purge operation and the first and second flushing operations are combined as described above. When the purge operation is performed, then the pressure is reduced in the interior of the cap 14*a* by using an unillustrated suction pump in the state in which the nozzles 5 and the dummy nozzles 31 are covered with the cap 14*a* provided for the purge unit 14, and the ink is discharged from the nozzles 5 and the dummy nozzles 31 (S11). The timer 41D counts the elapsed time after the purge operation performed by the purge unit 14 (S12). The flushing control mechanism 41C receives the signal from the timer 41D so that the second flushing operation is performed during a preset period after the purge operation performed by the purge unit 14 (S13). On the other hand, the first flushing operation is performed after the elapse of the preset period (S14).

In the embodiment described above, the ink discharge timing is changed between one nozzle group and the other nozzle group. In this procedure, when three or more sub-manifolds are provided for each of the manifolds 19 to 20 as in the embodiment described above in order to cause the flow of the ink with ease, the nozzle groups, in which the discharge mode is different from each other, can be set to the nozzle groups which are communicated with the mutually adjacent sub-manifolds. In other words, the nozzles belonging to one nozzle group may be communicated with one sub-manifold, and the nozzles belonging to the other nozzle group may be communicated with the distinct sub-manifold which is adjacent to the sub-manifold communicated with the nozzles of one nozzle group. In this way, the discharge modes of the nozzle groups communicated with the mutually adjacent sub-manifolds are different from each other between the mutually adjacent sub-manifolds. Therefore, the flow of the ink tends to arise with ease as compared with a case in which the sub-manifold communicated with one nozzle group and the sub-manifold communicated with the other nozzle group are separated from each other by a distance.

Figure 7:
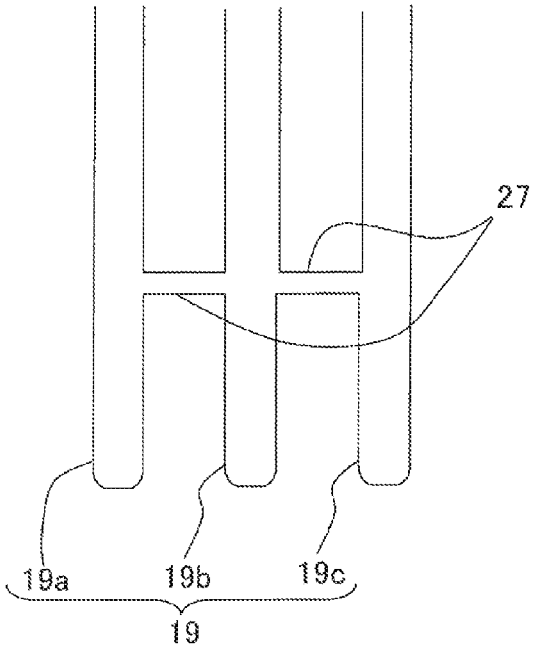
FIG. 7 shows a schematic view illustrating a communication channel provided at each of end portions of sub-manifolds.

In the embodiment described above, the communication channel is formed to mutually connect the ends of the plurality of sub-manifolds. However, the present teaching is not limited to such an arrangement. For example, as shown in FIG. 7, it is also allowable that the communication channel is formed to mutually connect portions other than the end portions of the plurality of sub-manifolds. Alternatively, it is also allowable that the communication channel is constructed to connect the end portion of a certain sub-manifold and a portion other than the end portion of another sub-manifold.

Figure 8:
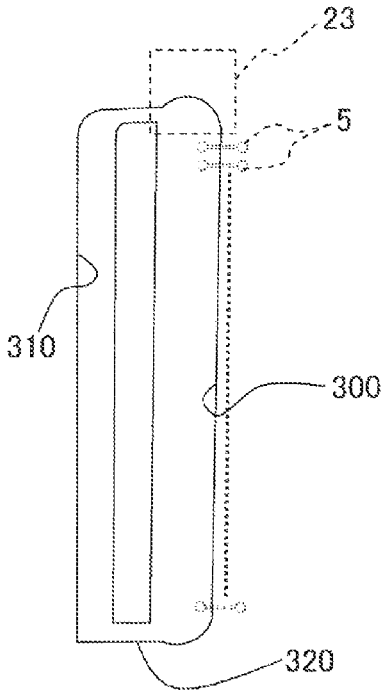
FIG. 8 shows a schematic view illustrating a communication channel communicated with an ink flow channel (an ink chamber) not communicated with any nozzle.

In the embodiment described above, the communication channel makes communication among the plurality of sub-manifolds. However, the present teaching is not limited to such an arrangement. For example, as shown in FIG. 8, it is also allowable to provide a communication channel 320 so that communication is made between a sub-manifold 300 which is communicated with a plurality of nozzles and an ink flow channel (an ink chamber, a liquid chamber) 310 which is not communicated with any nozzle. An end portion of the ink flow channel 310, which is disposed on a side opposite to the communication channel 320, is communicated with the sub-manifold 300. In such an arrangement, as described above, the nozzles, which are communicated with the sub-manifold 300, are divided into those of a plurality of nozzle groups depending on the distance from the communication channel 320, and the recording head 6 is controlled so that the discharge timing and/or the discharge mode is/are allowed to differ between one nozzle group and the other nozzle group. Accordingly, it is possible to generate the flow of the ink in the communication channel 320. In FIG. 8, the communication channel 320 is provided at one end of the sub-manifold 300. However, it is not necessarily indispensable that the communication channel 320 should be provided at the end portion of the sub-manifold 300. Further, it is not necessarily indispensable that the ink flow channel 310 should be communicated with the end portion of the sub-manifold 300.

In the embodiment described above, the apparatus has been explained, in which the present teaching is applied to the ink-jet type recording apparatus which discharges the inks. However, the present teaching is not limited thereto. The present teaching is also applicable, for example, to an arbitrary liquid droplet discharge apparatus such as a liquid droplet discharge apparatus which discharges liquid droplets of a conductive material in order to form a wiring pattern of a circuit board or a wiring board.

What is claimed is:

1. A liquid discharge apparatus which discharges a liquid to a medium, comprising:

a liquid discharge head having:

a plurality of nozzles through which the liquid is discharged;

a common chamber communicated with the nozzles and extending in an extending direction;

a liquid chamber;

a liquid supply port through which the liquid is supplied to a first end of the common chamber in the extending direction, and to the liquid chamber; and a communication channel which makes communication between the liquid chamber and the common chamber at a second end of the common chamber in the extending direction opposite to the first end; and a discharge control mechanism which is configured to control the liquid discharge head to perform a discharge operation of discharging the liquid from the nozzles to the medium;

wherein the plurality of nozzles have a first nozzle group and a second nozzle group;

wherein the discharge control mechanism controls the liquid discharge head to perform a flushing operation, as the discharge operation, so that the liquid is discharged from the first nozzle group in a discharge mode, which is different from a discharge mode of the second nozzle group, to generate a flow of the liquid in the communication channel;

wherein the first nozzle group includes:

a first nozzle subgroup; and a second nozzle subgroup which is located farther away from the communication channel than the first nozzle subgroup; and wherein the discharge control mechanism is configured to control the liquid discharge head to perform the flushing operation of the second nozzle group after performing the flushing operation of the first subgroup which is located nearer to the communication channel than the second nozzle subgroup.

2. The liquid discharge apparatus according to claim 1;

wherein the first nozzle group is constructed by the nozzles communicated with the common chamber; and wherein the liquid chamber includes another common chamber communicated with the second nozzle group.

3. The liquid discharge apparatus according to claim 2;

wherein the communication channel is communicated with the common chamber at one end portion in the extending direction of the common chamber; and wherein the communication channel is communicated with the another common chamber at one end portion in the extending direction of the another common chamber.

4. The liquid discharge apparatus according to claim 1, claim 1;

wherein the first nozzle group and the second nozzle group are communicated with the common chamber; and wherein the first nozzle group is communicated with the common chamber at a position nearer to the communication channel as compared with the second nozzle group.

5. The liquid discharge apparatus according to claim 4;

wherein the communication channel is communicated with the common chamber at one end portion in the extending direction of the common chamber; and wherein the liquid chamber is communicated with the common chamber at the other end portion in the extending direction of the common chamber.

6. The liquid discharge apparatus according to claim 2;

wherein the discharge control mechanism controls the liquid discharge head so that liming, at which the liquid is discharged from the nozzles, is changed between the first nozzle group and the second nozzle group.

7. The liquid discharge apparatus according to claim 2;

wherein the discharge control mechanism controls the liquid discharge head so that the liquid is discharged from the nozzles in the flushing operation in a discharge amount which is changed between the first nozzle group and the second nozzle group.

8. The liquid discharge apparatus according to claim 2;

wherein the second nozzle group includes a third nozzle subgroup, and a fourth nozzle subgroup which is located farther away from the communication channel than the third nozzle subgroup; and wherein the discharge control mechanism controls the liquid discharge head so that the liquid is discharged from the first and second nozzle subgroups at a different timing with each other.

9. The liquid discharge apparatus according to claim 2, further comprising:

a purge mechanism including a cap which makes contact with the liquid discharge head to cover the nozzles and which allows the liquid to be discharged from the nozzles in a state in which the cap is brought in contact with the liquid discharge head; and a timer which counts an elapsed time after a purge operation performed by the purge mechanism;

wherein the liquid discharge head has dummy nozzles which are communicated with the communication channel and from which the liquid is not discharged during the discharge operation;

wherein the purge mechanism is configured so that the cap is brought in contact with the liquid discharge head to cover the nozzles and the dummy nozzles to discharge the liquid from the nozzles and the dummy nozzles;

wherein the discharge control mechanism is configured to allow the recording head to perform another flushing operation in which the liquid is discharged from the nozzles so that all of the nozzles, which belong to the first and second nozzle groups, are in an identical discharge mode; and wherein the discharge control mechanism controls the liquid discharge head so that the another flushing operation is performed during a preset period after the purge operation performed by the purge mechanism by receiving a signal from the timer, while the flushing operation is performed after elapse of the preset period.

10. The liquid discharge apparatus according to claim 1;

wherein the liquid chamber includes two other common chambers;

wherein the first nozzle group is constructed by the nozzles communicated with the common chamber;

wherein the second nozzle group is constructed by the nozzles communicated with one of the two common chambers;

wherein the third nozzle group is constructed by the nozzles communicated with the other of the two common chambers; and wherein the common chamber which is communicated with the first nozzle group and the one of the two common chambers which is communicated with the second nozzle group are arranged adjacently to one another.

* * * * *